US005233777A

United States Patent [19]

Waterman, Jr. et al.

[11] Patent Number: 5,233,777

[45] Date of Patent: Aug. 10, 1993

[54] FIREARM SAFETY LOCK ASSEMBLY

[75] Inventors: Harold J. Waterman, Jr., Wallingford; Anthony L. Aeschliman, Killingworth, both of Conn.

[73] Assignee: The Marlin Firearms Company, North Haven, Conn.

[21] Appl. No.: 940,061

[22] Filed: Sep. 3, 1992

[51] Int. Cl.[5] ..... F41A 17/04

[52] U.S. Cl. ..... 42/70.11

[58] Field of Search ..... 42/70.11, 70.01, 96, 42/66

[56] References Cited

U.S. PATENT DOCUMENTS

| | | | |
|---|---|---|---|
| 2,327,334 | 9/1941 | Parker . | |
| 2,479,107 | 7/1948 | Garretson . | |
| 2,763,081 | 11/1953 | Huckabee . | |
| 2,887,807 | 7/1956 | Santangelo . | |
| 3,022,598 | 9/1960 | Wikstrom . | |
| 3,137,957 | 7/1962 | Ingalls . | |
| 3,708,901 | 1/1973 | Wolter . | |
| 3,710,490 | 1/1973 | Cornett et al. . | |
| 3,720,014 | 3/1973 | Goodrich . | |
| 3,768,189 | 10/1973 | Goodrich | 42/70.11 |
| 4,136,476 | 1/1979 | Hetrick . | |
| 4,224,753 | 9/1980 | Bielman . | |
| 4,398,366 | 8/1983 | Wernicki . | |
| 4,479,320 | 10/1984 | Fix | 42/70.11 |
| 5,038,508 | 8/1991 | Brown | 42/70.11 |
| 5,062,233 | 11/1991 | Brown | 42/70.11 |

FOREIGN PATENT DOCUMENTS

| | | | |
|---|---|---|---|
| 8300423 | 9/1984 | Netherlands | 70/233 |
| 22837 | 4/1912 | Norway | 42/70.11 |

*Primary Examiner*—Stephen M. Johnson

*Attorney, Agent, or Firm*—Chilton, Alix & Van Kirk

[57] ABSTRACT

A firearm safety lock assembly for preventing the loading and accidental discharge of a firearm employs a cable which extends between a chamber insert and a muzzle cap. The cap and the insert are seatable against opposing ends of the firearm barrel. The cable is locked by an armature extension of a lock which has a catch for receiving a lug fixed to the cable. Lock assemblies for a wide variety of firearm makes and models may be assembled from a single kit.

19 Claims, 2 Drawing Sheets

FIREARM SAFETY LOCK ASSEMBLY

BACKGROUND OF THE INVENTION

This invention relates generally to safety devices for firearms. More particularly, the present invention relates to safety devices which are employed to prevent ammunition from being loaded into the firearm and which are adapted for use in conjunction with a wide variety of firearm makes and models.

There are numerous types of firearm safety devices and locks. While conventional firearm safety devices, such as locked trigger guards, have proved to be effective, many of the more recent firearms safety devices have been directed to preventing the loading of ammunition into the firearm. Conventional safety devices have also been configured to be highly visible to ensure that the devices are securely locked in position. Because of the numerous makes, models and types of firearms, it is also highly desirable to provide a single firearm safety device or kit which is easily adaptable to a wide variety of firearms.

Brown U.S. Pat. Nos. 5,038,508 and 5,062,233 disclose firearm safety devices which prevent ammunition from being introduced into the chamber. When deployed the devices provide a visible indication that the firearm is not loaded. One disclosed device incorporates a plug attached to a cable and plug ring adapters. One of the adapters is selected to correspond to the barrel diameter for the given firearm. The cable is inserted into the barrel from the chamber and pulled through until the plug/plug ring combination is seated against the chamber opening. The safety is held in place by the combination of a restricting means and a clamp. The restricting means can be locked in place, thereby preventing unintended removal. A number of related firearm safety devices employ various structures which extend through the firearm barrel and engage the barrel chamber opening and the muzzle end of the firearm. Many of the conventional firearm safety devices incorporate locking mechanisms for securing the safety devices in position with the firearms. Various U.S. patents to which the invention relates are set forth by patentee and patent number below.

| Patentee | U.S. Pat. No. |
|---|---|
| Parker | 2,327,334 |
| Garretson | 2,479,107 |
| Huckabee | 2,763,081 |
| Santangelo | 2,887,807 |
| Wikstrom | 3,022,598 |
| Ingalls | 3,137,957 |
| Wolter | 3,708,901 |
| Cornett et al | 3,710,490 |
| Goodrich | 3,720,014 |
| Hetrick | 4,136,476 |
| Bielman | 4,224,753 |
| Wernicki | 4,398,366 |
| Fix | 4,479,320 |
| Mathew | 4,512,099 |
| Thurber | 4,783,924 |
| Healey et al | 4,969,284 |
| Madden | 4,999,940 |
| Derman | 5,001,854 |

SUMMARY OF THE INVENTION

Briefly stated, the invention in a preferred form is a safety lock assembly for a firearm. The safety lock assembly engages at the chamber opening to the firearm barrel, extends through the firearm barrel and is exteriorly secured proximate the muzzle end of the firearm. The safety lock assembly prevents ammunition from being loaded into the firearm. The safety lock assembly also presents a highly visible indication that the device is locked in position and that the firearm is not loaded. The firearm lock assembly which may be assembled from a kit is readily adaptable for use with a wide variety of firearm makes and models, including handguns, rifles and shotguns.

The safety lock assembly includes a cable which has a stud having a flange fixed at one end of the cable and a lock lug fixed at the other end of the cable. A cap engages the muzzle end of the firearm and includes an axial bore which permits passage of the cable and lock lug. A chamber insert has an axial bore which receives the stud so that the flange engages the insert to retain the insert to the cable. The insert may have a truncated disk-like form or may have a forward tapered end with the bore having an enlarged and a reduced axial portion. A lock, which includes an armature having a catch, locks with the lock lug to retain the cable within the firearm.

The stud may have a cylindrical portion defining an axial cavity for receiving an end portion of the cable. The cap has a forward surface having a tapered conical shape. The armature is a generally U-shaped member with one leg defining the catch. The lug has a generally cylindrical portion defining an axial cavity for receiving an end portion of the cable and also includes a recess which is partially defined by an annular shoulder. The armature engages the shoulder in a surface-to-surface relationship when the lock lug is locked with the armature.

An object of the invention is to provide a new and improved lock assembly for enhancing firearm safety and preventing accidental firearm discharge.

Another object of the invention is to provide a new and improved firearm safety lock assembly which provides a highly visible indication that the assembly is mounted in a locked position and the firearm is not loaded.

A yet further object of the invention is to provide a new and improved firearm safety lock assembly which is adaptable for a wide variety of firearm makes and models.

Other objects and advantages of the invention will become apparent from the specification and the drawings.

DETAILED DESCRIPTION OF THE PREFERRED EMBODIMENT

Figure 1:
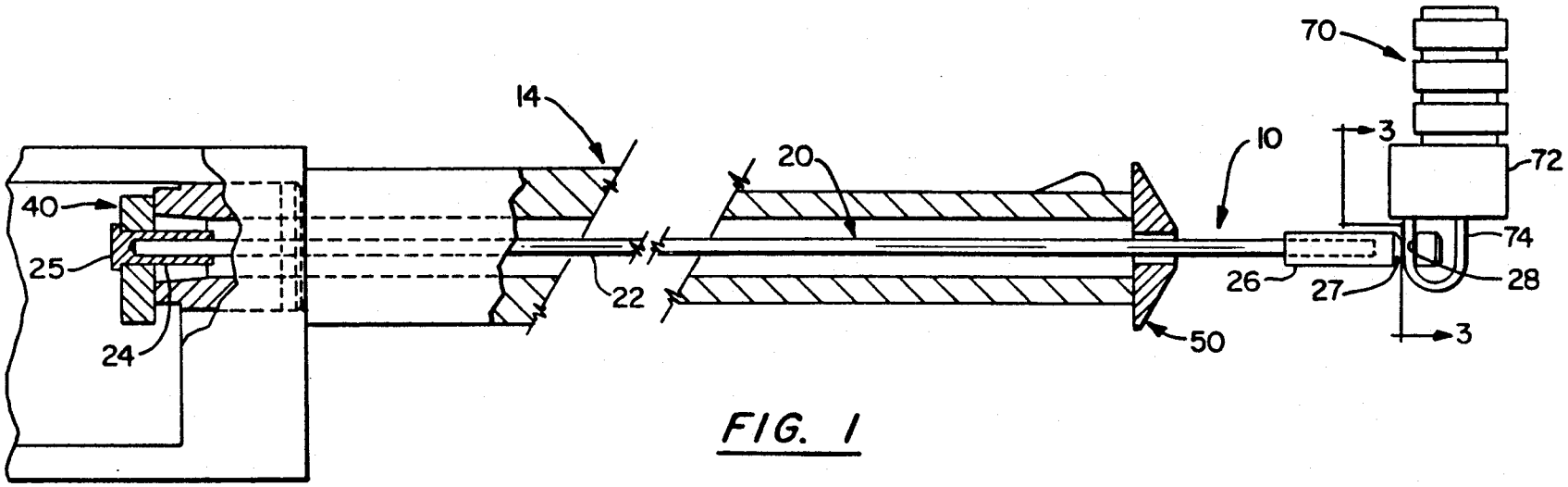
FIG. 1 is a side elevational view, partly in section, partly in phantom and partly broken away, illustrating a firearm and a firearm safety lock assembly in accordance with the present invention.

With reference to the drawings wherein like numerals represent like parts throughout the several figures, a firearm lock assembly in accordance with the present invention is generally designated by the numeral 10 in FIG. 1. The safety lock assembly 10 is especially adapted for use in connection with a wide range of firearm makes and models, including handguns, rifles and shotguns. The safety lock assembly 10 is assembled from a quasi-universal kit according to the given firearm specifications. The assembled lock assembly 10 is illustrated in conjunction with a shotgun 14 in FIG. 1. A second assembled lock assembly is illustrated in conjunction with rifle 16 in FIG. 2. Similar suitably dimensioned safety lock assembly embodiments are applicable to handguns. The safety lock assemblies 10, 12 function to prevent the loading of ammunition into the firearm chamber and also present a highly visible indication that the assembly is properly secured and that the firearm is not loaded. In addition, the lock assemblies 10, 12 are adapted to be locked to the firearm so that the safety assembly cannot be removed without the appropriate key or lock combination.

The safety lock assembly preferably is marketed in the form of a kit for either a handgun or a long gun. Each kit includes a pair of cable sub-assemblies 20, a centerfire chamber insert 30, multiple chamber disks 40, a muzzle spacer 50, and a lock 70. For a given firearm, the appropriately dimensioned cable sub-assembly 20 is selected. A centerfire chamber insert 30 or an appropriately dimensioned chamber disk 40 may be selected in accordance with the firearm chamber characteristics. For rimfire chambers, neither an insert 30 nor a disk 40 is required. Each assembled safety lock assembly includes a muzzle spacer 50 and a lock 70.

The cable sub-assembly 20 comprises a flexible steel cable 22 which is preferably manufactured from woven steel wire and encased with a vinyl coating. One end of the cable 22 is inserted into a rimfire stud 24 which has a rear rim or flange 25. The stud 24 is brazed or mechanically fixed to the cable. The opposing end of the cable is inserted and brazed or mechanically fixed into an axial opening of a brass lock lug 26. The lock lug 26 has a circumferential forward recess 27 forwardly defined by a transverse annular lock shoulder 28. The length of cable 22 is selected so that the pre-established distances D between lock shoulder 28 and flange 25 (when the cable 22 is taut) accommodate the numerous standard barrel dimensions for firearms. In a preferred embodiment, the handgun cable sub-assemblies 20 for the handgun kit have distances D of 8.35 and 14.85 inches and the cable sub-assemblies for the long gun kit have distances D of 20.85 and 30.85 inches.

Figure 2:
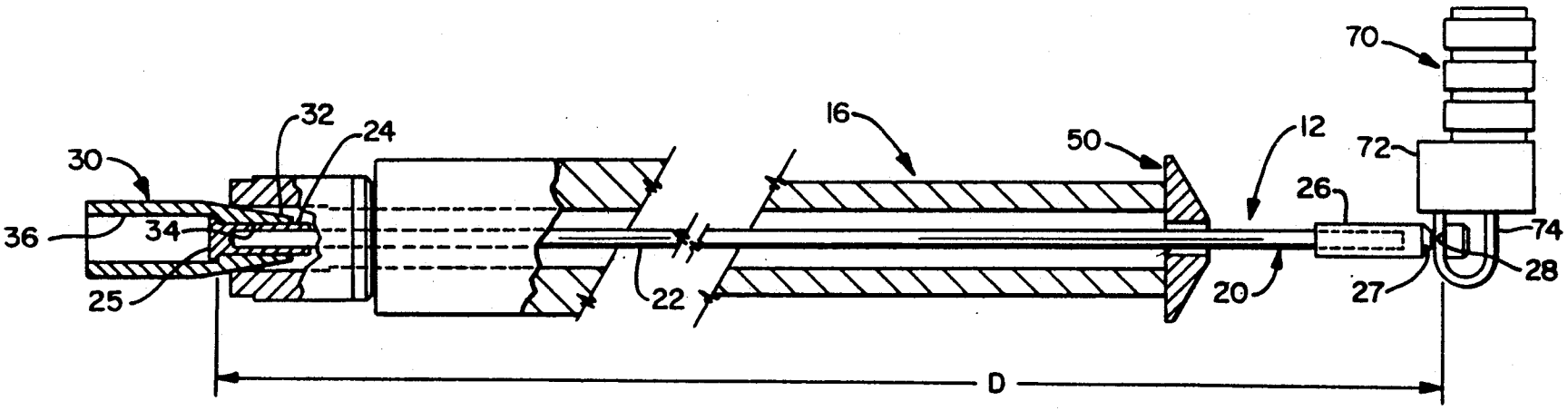
FIG. 2 is a side elevational, partly in section, partly in phantom and partly broken away, illustrating a second firearm and a second embodiment of a firearm safety lock assembly in accordance with the present invention.
Figure 4:
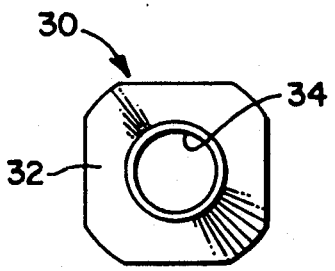
FIG. 4 is an enlarged frontal end view of a chamber insert for the assembly of FIG. 1.

With reference to FIGS. 2 and 4, the centerfire chamber insert 30 normally employed for rifles and pistols is an elongated member having a forward tapered nose 32. The insert has an axial bore 34 and a counterbore 36. The reduced bore 34 has a diameter which is dimensioned to closely accommodate the rimfire stud 24 so that the insert may receive the stud with the flange 25 engaging the end surface of counter bore 36. The frontal surface of the insert nose 32 has a symmetrical tapered configuration which allows the insert to be seated into the chamber end of the barrel at an axial position which is determined by the diameter of the firearm chamber or other barrel breech opening such as a revolver forcing cone, as best illustrated in FIG. 2. The chamber insert 30 is preferably manufactured from a composite material or other non-abrasive non-corrosive material.

Figure 5:
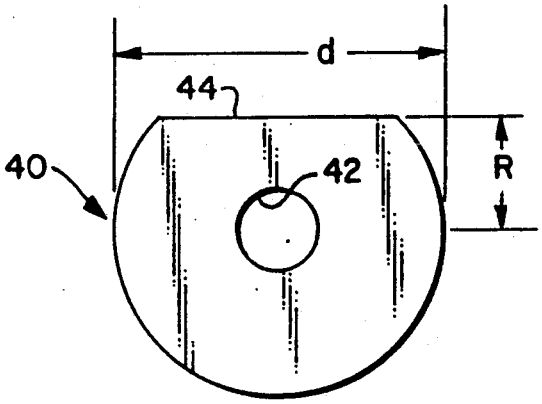
FIG. 5 is an enlarged frontal end view of a chamber disk for the assembly of FIG. 2.

With reference to FIGS. 1 and 5, the chamber disk 40, which is ordinarily employed in connection with shotguns or revolvers, is a truncated disk-like member having an axial bore 42 which is slightly greater than the diameter of the rimfire stud 24. When installed in the firearm, the disk 40 has an upper chord-like edge 44. The bore 42 is dimensioned so that the chamber disk can be slidably mounted over the rimfire stud 24 with the flange 25 engaging the rear side of the chamber disk. The disk 40 is preferably manufactured from a composite material or other non-abrasive non-corrosive material. The chamber disk 40 is further dimensioned to have a diameter which is greater than the diameter of the shotgun (or revolver) barrel and is axially dimensioned so that the disk may be received in the chamber and seated against the chamber opening to the barrel, as best illustrated in FIG. 1.

The maximum diameter d and the truncated radius R (distance from the center to edge 44) of the chamber disk 40 are dimensioned to correspond to various shotgun gauges as set forth in Table I.

TABLE I

| COMPONENT | d (inch) | R (inch) | GAUGE |
|---|---|---|---|
| 40A | .55 | .22 | 410 |
| 40B | .70 | .25 | 28 |
| 40C | .77 | .25 | 16–20 |
| 40D | .90 | .30 | 10–12 |

The long gun kit preferably includes disks 40A, 40B, 40C and 40D and the handgun kit includes disks 40A and 40B. Indicia identifying the corresponding gauge may be affixed to the disk.

Figure 6:
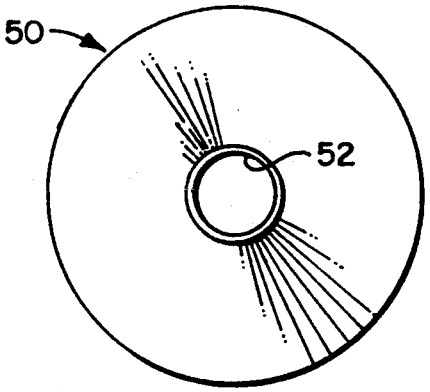
FIG. 6 is an enlarged frontal end view of a muzzle spacer for the lock assembly of FIG. 1.

With additional reference to FIG. 6, muzzle spacer 50 is a tapered cap-like member having a central axial bore 52 with a diameter which is slightly greater than the diameter of the lock lug 26, so that the cable lock lug 26 may be inserted through the bore 52. The muzzle spacer 50 preferably is formed from a composite material or other non-abrasive non-corrosive material and has a diameter which is greater than the diameter of the barrel. In one preferred embodiment, the spacer has a maximum thickness of 0.25 inch and a diameter of 1.00 inch.

Figure 3:
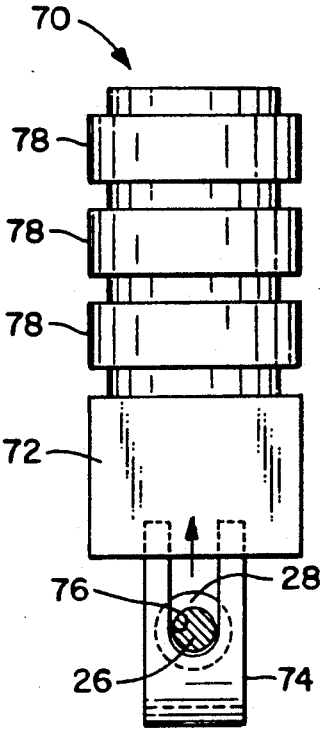
FIG. 3 is an enlarged interior view, partly in phantom, of a lock employed in the lock assembly of FIG. 1 and taken along the line 3—3 thereof.

Lock 70 is a combination lock. A key actuated lock or other locking device may also be employed. With reference to FIGS. 1, 2 and 3, the lock 70 has a casing 72 which receives a projectable latchable armature 74. The armature 74 is a U-shaped member having an open-ended slot-like catch 76. The catch 76 is accessible in the unlocked projected configuration of the armature 74. The catch 76 is closely dimensioned so that the catch slides into the lock lug recess 27 in the unlocked position to thereby capture the lock lug 26. The forward planar surface of catch 76 engages against shoulder 28 in surface-to-surface fashion when the armature is latched with (retracted into) the lock casing.

When the lock is locked, such as illustrated in FIG. 3, the retracted armature 74 secures the muzzle spacer 50 to the cable sub-assembly. The cable sub-assembly is retained in position in the barrel as illustrated in FIGS. 1 and 2. The lock 70 prevents removal of the safety lock assembly from the firearm. The lock 70 is effective even though for some applications there may be a significant spacing between the muzzle spacer 50 and the lock 70. The spacing may result from the pre-established length 22 of the cable sub-assembly which does not precisely match the optimum dimensions for all firearms. Lock 70 includes three combination rings 78.

With reference to FIGS. 1 and 2, the safety lock assembly is installed in the firearm by first determining whether the rim stud 24 is sufficient and, if necessary, selecting the appropriate centerfire chamber insert 30 or chamber disk 40. The selection naturally will depend on the given firearm configuration. For the FIG. 1 application, the cable subassembly 22 is then inserted through the bore 42 of the chamber disk 40, and the cable subassembly is inserted from the chamber end of the barrel through the barrel until the forward portion of the cable extends through the muzzle end of the firearm. The cable is then drawn taut so that the disk 40 seats against the chamber end of the firearm. The muzzle spacer 50 is then mounted to the cable sub-assembly 22 b sliding the spacer over the lock lug 26 for engagement against the muzzle end of the firearm. The projected armature 74 of the lock is then latched to the cable assembly by engaging the catch 76 with the lock lug26. The armature is latched into the casing. The armature 74 may engage against the forward end of the muzzle spacer and the adjacent lock lug to provide a snug taut axial fit or may be spaced away from the end of the muzzle. the lock is securely locked in position by forcing the armature into the lock casing. The safety lock assembly provides a safety device of high integrity regardless of the disposition of the lock relative to the end of the muzzle.

FIG. 2 illustrates a locked safety lock assembly 12 wherein the centerfire chamber insert 30 is mounted to the cable sub-assembly 22 and seated at the chamber end of the barrel.

It will be appreciated that the foregoing safety lock assemblies 10 and 12 each provides an efficient firearm safety device which may be securely mounted in position by selecting the appropriate components for the given firearm from a universal kit having relatively few components. Thus, the lock assembly may be employed with a wide range of firearm makes and models. The lock assembly functions to prevent ammunition from being loaded into the chamber of the firearm. In addition, the protruding portion at the muzzle end of the firearm including the lock provides a strong visual indication that the firearm is unloaded and that the safety lock is properly positioned and locked in place. The lock assembly, once locked, can be effectively released only by unlocking the lock 70. Thus, the safety assembly may be maintained in the locked position so as to prevent accidental firearm discharge unless the appropriate combination, key or unlocking means is employed to unlock the lock.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A kit for a firearm safety lock assembly comprising:

cable means comprising a cable having opposed first and second ends and stud means having a flange fixed at one end of said cable and lug means fixed to the other end of said cable;

cap means comprising a cap adapted to engage a muzzle end of a firearm, said cap defining an axial bore dimensioned to permit passage of said cable and lug means therethrough;

chamber insert means comprising first and second inserts, each said insert defining an axial bore dimensioned to receive said stud means so that said flange engages said insert, said first insert having a planar forward end and said second insert having a tapered forward end; and lock means comprising an armature defining a catch for receiving said lug means and locking therewith so that said armature is locked to said lug means and said cable means extends through a firearm barrel of said firearm and is retained at said opposing ends therewith by either said first or second insert means and said cap means.

2. The kit of claim 1 wherein said stud means has a cylindrical portion defining an axial cavity which receives said one end of said cable.

3. The kit of claim 1 wherein said cap means comprises a pair of axially spaced surfaces, a first surface of said spaced surfaces adapted to engage the muzzle end of the firearm, and the second surface of said spaced surfaces having a tapered conical shape.

4. The kit of claim 1 wherein said armature is a generally U-shaped member having one leg defining said catch.

5. The kit of claim 1 wherein said lug means has a generally cylindrical portion defining an axial cavity and said other end of the cable is received in said cavity.

6. The kit of claim 1 wherein said second insert defines an axial bore having a reduced and an enlarged portion, said reduced portion of said bore being dimensioned to closely receive said stud means and the enlarged portion adapted to receive said flange so that said flange is engagable against an end portion of said enlarged portion.

7. The kit of claim 1 wherein said first insert comprises a disk-like member which is truncated at one edge portion thereof.

8. The kit of claim 1 wherein said lug means defines a recess and said catch engages said lug means at said recess.

9. The kit of claim 8 wherein said recess is at least partially defined by an annular shoulder of said lug means and said armature engages said shoulder in a generally surface-to-surface relationship.

10. The kit of claim 1 further comprising at least one insert, said at least one insert and said first insert have generally the same shape, and said at least one insert has dimensions which differ from said first insert.

11. A firearm safety lock assembly for a firearm having a barrel including a chamber end and a muzzle end thereof:

cable means comprising a cable having opposed first and second ends and stud means having a cylindrical portion defining an axial cavity which receives said first end of said cable in fixed relationship and having a flange and a lug defining a lock recess fixed to said second end of said cable, wherein said barrel has a length and said cable means has an axial length which exceeds the length of said barrel;

cap means comprising a cap adapted to engage the muzzle end of said barrel and having a diameter greater than the barrel diameter, said cap defining an axial bore dimensioned to permit passage of said cable therethrough;

chamber insert means comprising an insert defining an axial bore dimensioned to receive said stud means so that said flange engages axially against said insert and said insert is seatable at a chamber end of said barrel; and lock means comprising a U-shaped armature defining a catch for said lug at said recess, said armature being lockable with said lug so that said cable means is extendable through the firearm barrel and lockably retained at the opposing ends therewith by said insert means and said cap means.

12. The safety lock assembly of claim 11 wherein said cap means comprises a pair of axially spaced surfaces, a first surface of said spaced surfaces adapted to engage the muzzle end of the firearm and the second surface of said spaced surfaces having a tapered conical shape.

13. The safety lock assembly of claim 11 wherein said lock means includes a lock casing and said armature catch comprises a planar extension having a generally U-shape defined by a pair of legs which are received in said casing when said armature is locked to said lug.

14. The safety lock assembly of claim 13 wherein said lock recess is partially defined by an annular shoulder of said lug means and said planar extension engages said shoulder in generally surface-to-surface relationship.

15. The safety lock assembly of claim 11 wherein said lug has a generally cylindrical portion defining an axial cavity and said second end of the cable is received in said cavity.

16. The safety lock assembly of claim 11 wherein said insert means comprises a member defining an axial bifurcated bore, a reduced portion of said bore being dimensioned to closely receive said stud means and an enlarged portion adapted to receive said flange so that said flange is engagable against an end portion of said enlarged bore portion.

17. The safety lock assembly of claim 11 wherein said insert means comprises a truncated disk-like member.

18. A kit for a firearm safety lock assembly comprising:

cable means comprising a cable having opposed first and second ends and stud means fixed at one end of said cable and lug means defining a lock surface fixed to the other end of said cable;

cap means comprising a cap adapted to engage a muzzle end of a firearm, said cap defining an axial bore dimensioned to permit passage of said cable and lug means therethrough;

chamber insert means comprising first and second inserts, each said insert engageable with said stud means to mount said insert to said cable means, said first insert having a planar forward end and said second insert having a tapered forward end; and lock means comprising a U-shaped armature defining a catch for capturing said lug means at said lock surface and locking therewith so that said armature is locked to said lug means and said cable means extends through a firearm barrel of said firearm and is retained at said opposing ends therewith by either said first or second insert means and said cap means.

19. The kit of claims 18 wherein said lock means is a combination lock having a casing and said armature is projectable in an unlocked mode and retractable in a locked mode relative to said casing and wherein said catch is accessible for engaging and disengaging said lug means in the unlocked mode.

* * * * *